US005922192A

United States Patent [19]

Zimmermann et al.

[11] Patent Number: 5,922,192

[45] **Date of Patent: *Jul. 13, 1999**

[54] APPARATUS AND PROCESS FOR REDUCING COKING OF HEAT EXCHANGE SURFACES

[75] Inventors: Gerhard Zimmermann; Wolfgang Zychlinski, both of Leipzig, Germany

[73] Assignee: Mannesmann Aktiengesellschaft, Düsseldorf, Germany

[ * ] Notice: This patent is subject to a terminal disclaimer.

[21] Appl. No.: 08/682,553

[22] PCT Filed: Feb. 21, 1995

[86] PCT No.: PCT/DE95/00281

§ 371 Date: Jul. 22, 1996

§ 102(e) Date: Jul. 22, 1996

[87] PCT Pub. No.: WO95/22588

PCT Pub. Date: Aug. 24, 1995

[30] Foreign Application Priority Data

Feb. 21, 1994 [DE] Germany ..... 44 05 884

[51] Int. Cl.[6] ..... C10G 9/16

[52] U.S. Cl. ..... 208/48 R; 208/48 AA; 208/130; 208/131; 208/132; 585/648; 585/650; 585/950; 422/198

[58] Field of Search ..... 208/48 R, 48 AA, 208/132, 130, 131; 585/648, 649, 650, 950

[56] References Cited

U.S. PATENT DOCUMENTS

| | | | |
|---|---|---|---|
| 4,692,234 | 9/1987 | Porter et al. | 208/48 AA |
| 5,208,069 | 5/1993 | Clark et al. | 427/226 |
| 5,358,626 | 10/1994 | Gandman et al. | 208/48 R |
| 5,413,700 | 5/1995 | Heyse et al. | 208/134 |
| 5,616,236 | 4/1997 | Brown et al. | 208/48 R |
| 5,656,150 | 8/1997 | Reed et al. | 208/48 R |

*Primary Examiner*—Bekir L. Yildirim

*Attorney, Agent, or Firm*—Cohen, Pontani, Lieberman & Pavane

[57] ABSTRACT

A heat exchange surface in reactors and/or heat exchangers of installations for the conversion of hydrocarbons and other organic compounds at high temperatures in the gaseous phase. According to the invention, the metallic surfaces coming into contact with the organic substances are treated at a temperature of 300 to 1000° C. over a period of 0.5 to 12 hours with a mixture of a silicon- and sulfur-containing product and a dry gas flow which is inert with respect to the silicon- and sulfur-containing product. The invention is further directed to a process for producing a catalytically inactivated metallic surface in chemical reactors and/or heat exchangers.

20 Claims, 10 Drawing Sheets

APPARATUS AND PROCESS FOR REDUCING COKING OF HEAT EXCHANGE SURFACES

FIELD OF THE INVENTION

The invention is directed to heat exchange surfaces in reactors and tubular heat exchangers in installations for converting hydrocarbons and other organic compounds in relation to the problem of coke formation on these exchange surfaces.

BACKGROUND OF THE INVENTION

In order to produce ethylene and other lower olefins, hydrocarbons or mixtures of hydrocarbons are thermally cracked, for example in externally heated reactors formed of metallic materials and the hot cracked products obtained thereby are cooled after leaving the cracking furnace in heat exchanger apparatuses which are operated externally with water under pressure serving as coolant.

The cracking furnaces are preferably formed of high-temperature steels containing chromium and nickel. The tubular heat exchangers are preferably formed of low-alloy steels or boiler construction steel. This apparatus can also be used to produce other organic products, e.g., as in the production of vinyl chloride by pyrolysis of 1,2-dichloroethane.

The operating efficiency of such apparatus formed of metallic materials is highly dependent on the extent of carbon-rich deposits forming at their inner surfaces during operation. Such deposits can not only impede the desired heat transfer, but can also reduce the free cross section of the employed tubes which is important for maintaining throughput. This is true of currently used apparatus 25. FIG. 1 shows a typical curve A for the dependence of the quantity of deposited coke-like products m on the reaction time t.

After a certain period of operation, the deposits formed on the sides of the apparatus coming into contact with the organic compounds reach a permissible coke layer thickness S, as shown in FIG. 1, which causes reductions in output and necessitates the shutdown of operations and costly cleaning procedures. The coke-like deposits are usually removed by gasification using a mixture of hot steam and air which uncovers the metallic surfaces and ensures the desired heat flow.

In spite of thorough removal of the deposited coke, the newly forming deposits can again lead to compulsory shutdown and coke removal procedures already after a relatively short period of operation (e.g., 20 to 60 days). Since the applied oxidative decoking procedures simultaneously bring about a change in the material surfaces, such decoking procedures always involve an increase in the catalytic activity of the material surfaces which promotes unwanted surface coking. This catalytic activity increases with the number of decoking procedures to which the respective heat exchange surface is subjected and the operating periods between decoking procedures decline steadily. This is undesirable for technical reasons as well as from an economic viewpoint because it not only prevents maximum periods of stationary operating states, but also reduces the effective use of the installation and results in increasingly frequent cleaning costs. For these reasons, efforts have been made for years to find solutions for preventing rapid coking of the inner surfaces of such apparatus. In order to achieve this objective, it has been suggested, among other things, to prevent the formation of catalytically active centers or to inhibit such formation on the inner surfaces of tubes of the respective apparatus by developing passivating oxide coats, as described in U.S. Pat. No. 3,919,073; to coat the inner walls of the tubes with thin coats of low-alloy or nickel-free steels, as described in German patent publication DE-A 3 2476 568, to generate supporting layers or diffusion layers of chromium, as described in the publication by Brown, S. M. and Albright, L. F. *ACS Symp. Ser.* 32 (1976) 296, aluminum, as described in the publication by Frech, K. J., Hopstock, F. H. and Hutchings, D. A. *ACS Symp. Ser.* 32 (1976) 197, or silicon, as described in the publications by Brown, D. E., Clark, J. T. K., Foster, A. J., McCaroll, J. J. and Simms, M. L. *ACS Symp. Ser.* New York 202 (1982) 23; Bach, G., Zychlinski, W., Zimmermann, G., Kopinke, F. D. and Anders, K. *Chem. Techn.* Leipzig 42 (1990) 146; Ansari, A. A., Saunders, S. R. J., Bennett, M. J., Tuson, A. T., Ayers, C. F. and Steen, W. M. *Materials Science and Engineering* 88 (1987) 135; and to add additives in the form of gas or steam of sulfur-containing compounds, as described in the publication by Boene, K. *Oilgas J.* 81 (1983) 93, phosphorus-containing compounds, as described in the publication by Gosh, K. K. and Kunzru, D. *Ind. Engng. Chem. Res.* 27 (1988) 559 and in U.S. Pat. Nos. 4,835,332; 4,842,716; and 4,900,426, and nitrogen-containing compounds, as described in the publication by Egiasarov, J. G., Cores, B. Ch. and Potapova, L. L. "Neftechimija." *Erdölchem* 25 (1985) 627, to the charging product.

As disclosed in U.S. Pat. Nos. 4,835,332; 4,842,716; and 4,900,426 it is known to reduce the formation of coke-like deposits on the inner surfaces of reactors by adding organic phosphorus compounds. The organic phosphorus compounds (including organic thiophosphorus) can be used as such or as constituents of special compounds. The addition of organic phosphorus compounds is always linked with the formation of more or less volatile phosphines which are not only toxic but can also lead to catalyst contamination in the downstream processes. The addition of organic phosphorus compounds is effective only within a limited scope.

Contradictory assertions have been made, such as those disclosed in Czechoslovakian patent publication CS-A 180861 and in the publication by Froment, G. F. *Reviews in Chem. Eng.* 6(4) (1990) 293, concerning the effect of sulfur compounds on coking. Nevertheless, sulfur compounds are frequently used in industrial practice hydrocarbon fractions (naphtha, kerosine, gas oil, etc.), the addition of sulfur compounds has hardly any discernable effect on coking. They contain ad hoc sulfur compounds as mixture components. However, a more or less pronounced formation of coke-like deposits is observed during the pyrolysis of such hydrocarbon fractions.

In addition, although the application of oxidic protective coatings, as is suggested, in European patent publication EP-A 0 110 486, would lead to improvements, it cannot be considered a satisfactory solution.

A further improvement is provided by a coating based on silicon oil which is subsequently thermally decomposed under strictly specified conditions to produce a protective layer, as described in the publication *Chem. Tech.* Leipzig 42 (1990) 146. This process, like the production of laser-induced $SiO_2$ surface layers, is relatively costly and the generated $SiO_2$ layers are not stable during changes in the temperature of the outer tube wall in the range of 750 to 1100° C. This also applies to any passivated layers obtained by the silica coating which is described by British Petroleum Co. Ltd. in the publication *ACS Symp. Ser.* New York, 202 (1982) 23–43 in comparison with the publication *Chem Techn.* Leipzig 42 (1990) 146 ff.

Finally, reference is made to the attempted use of tubes of steel alloys whose inner surface is coated by thin coats of low-alloy or nickel-free steels described in German patent publication DE-A 3 247 568. It has been shown that the results of such plating do not justify the effort.

With the exception of the reduction of coke formation through the addition of phosphorus- and/or sulfur-containing additives to the pyrolysis charging products, all of the proposed solutions described above can only be practically carried out in new installations or in new tubing, but not in installations which have already been in use.

Therefore, the object of the present invention is to propose new improved heat exchange surfaces and to provide a process for reducing coking by which the respective apparatus (outfitting) of an installation which has already been completely installed can be subjected to such treatment before being put into operation and also after every decoking procedure.

SUMMARY OF THE INVENTION

According to the invention, the heat exchange surface in reactors and/or heat exchangers of installations for converting hydrocarbons and other organic compounds at high temperatures in the gaseous phase is characterized in that the metallic surfaces coming into contact with the organic substances are treated at a temperature of 300 to 1000° C. over a period of 0.5 to 12 hours with a mixture of a silicon- and sulfur-containing product and a dry gas flow which is inert with respect to the silicon- and sulfur-containing product.

For this purpose, the silicon- and sulfur-containing product is selected from (1) one or more silicon- and sulfur-containing volatile compounds, (2) a mixture of silicon-containing volatile compounds and a mixture of sulfur-containing volatile compounds, and (3) a mixture of silicon- and sulfur-containing volatile compounds and volatile silicon-containing and/or volatile sulfur-containing compounds, wherein the atomic ratio of silicon to sulfur in (1), (2) or (3) is 5:1 to 1:1. Particularly advantageous compounds are trimethylsilyl mercaptan, dimethyl sulfide, dimethyl disulfide, and bis(trimethylsilyl) sulfide and mixtures thereof.

If the heat exchange surface which is treated according to the invention is the metallic inner surface of the tubes of a tubular reactor, the treatment temperature is 800 to 1000° C. If the heat exchange surface which is treated according to the invention is the metallic inner surface of the tubes of a heat exchanger downstream of the tubular reactor, the treatment temperature is 300 to 750° C. However, in the latter case a higher temperature can also be employed locally. Thus, the temperature at the baffle plate at the input of the heat exchanger can also exceed 800° C. in certain cases, e.g., 875° C. Normally, however, the temperature remains within the range indicated above.

As was already stated, the treatment period is generally 0.5 to 12 hours. The effect of a treatment period of less than 0.5 hours is not sufficient to show a long-lasting effect. Periods in excess of 12 hours are possible, but are generally uneconomical.

The invention is based on the surprising insight that the very substantial increase in coking which is always observed when initially putting into operation cracking furnaces whose reactor tubes are new or whose inner surfaces are freed of carbon-rich products which have already been deposited can be effectively reduced in that the inner surfaces of the tubes coming into contact with the cracked products after being put into operation are subjected to a suitable high-temperature treatment with silicon- and sulfur-containing volatile compounds before the cracking furnace is put into operation for the first time and/or after every time the crack furnace is put into operation thereafter subsequent to steam/air decoking. This is advisably effected in such a way that a mixture of silicon- and sulfur-containing compounds and an inert dry carrier gas which receives the compounds upon which the invention is based is sent through the tubes of a cracking furnace and of the tubular heat exchanger connected thereto in a composition such that the catalytically active centers which are present a priori on the inner surfaces of the tubes and which are responsible for the catalytic coke formation are converted by chemical reactions into catalytically passive surface compounds and an enrichment of the elements contained in the compounds according to the invention, namely silicon and sulfur, takes place in the form of reactive species in the surface of the metallic materials. When the catalytically active centers on the inner surface of the tubes are converted accompanied by the formation of catalytically inactive surface compounds and the silicon- and sulfur-containing species have penetrated into the material surface to a sufficient extent, the cracking furnace, including the tubular heat exchanger, can be put into operation again. Since the coatings on the inner surface of the tubes are enriched, especially in silicon, and the catalytically active centers are inactivated by the growth of thermally stable and catalytically inactive silicon-sulfur species, a recurrence of coking will take place only after a long delay and at a very low level, as represented by curve B in FIG. 1. As a result of this comparatively simple additional treatment prior to putting a completely assembled cracking furnace into operation for the first time or after the cracking furnace has been subjected to a conventional cleaning by decoking with a steam/air mixture, the present invention makes it possible to considerably prolong the operating times of cracking furnaces. Significantly, the cracking furnaces and tubular heat exchangers themselves need not undergo any structural modification and the process is also applicable to installations which are already in operation. There is no need for costly coating of prefabricated tubes which must be welded during assembly so that the protective coatings are partially destroyed and the desired effect is partially cancelled. Furthermore, the application of closed cover layers which can impede the transfer of heat is avoided.

It has proven advantageous to convey a mixture of an inert, dry carrier gas, such as the head product from the demethanizer of the cracked gas decomposition system or nitrogen, and the compounds according to the invention through the furnace system at the conventional operating temperature for a cracking furnace, i.e., at tube wall temperatures above 800° C., and at the usual operating temperature for a tubular heat exchanger (TLE), i.e., at roughly 400 to 550° C., wherein the molar ratio of the silicon- and sulfur-containing compounds to the carrier gas is between 0.0005 and 0.03 and a treatment period ranges between 30 minutes and 12 hours depending on the concentration of the silicon- and sulfur-containing compounds. In addition to compounds containing silicon and sulfur simultaneously, mixtures of silicon-containing and sulfur-containing compounds can also be used. The atomic ratio of silicon to sulfur can range between 5:1 and 1:1, preferably between 1:1 and 2:1. The pressure of the mixture sent through the system can correspond to the usual pressures in a cracking furnace system, e.g., 0.5 to 20 bar, preferably in a range of 1 to 2 bar. A carrier gas other than the inert gas for the system can also be used.

The invention will be explained more fully in the following with reference to a number of comparison examples and embodiment examples according to the invention. FIGS. 2 to 10 illustrate the dependency of the coking rates in preactivated test pieces of chromium-nickel steel on the test period during the pyrolysis of n-heptane, in some cases after thermal pretreatment according to the invention.

DETAILED DESCRIPTION OF THE PRESENTLY PREFERRED EMBODIMENTS

EXAMPLE 1

Comparison Example

The deposition rates of solid, coke-like deposits on metallic materials during the pyrolysis of hydrocarbons can be measured in special vertically arranged, electrically heatable laboratory reactors when the corresponding material test pieces are suspended within these reactors on a thin platinum or quartz wire and are connected with a thermal scale, in comparison with that described in the publication by Kopinke, D., Bach, G. and Zimmermann, G. J. *Anal. Appl. Pyrolysis* 27 (1993) 45.

Figure 1:
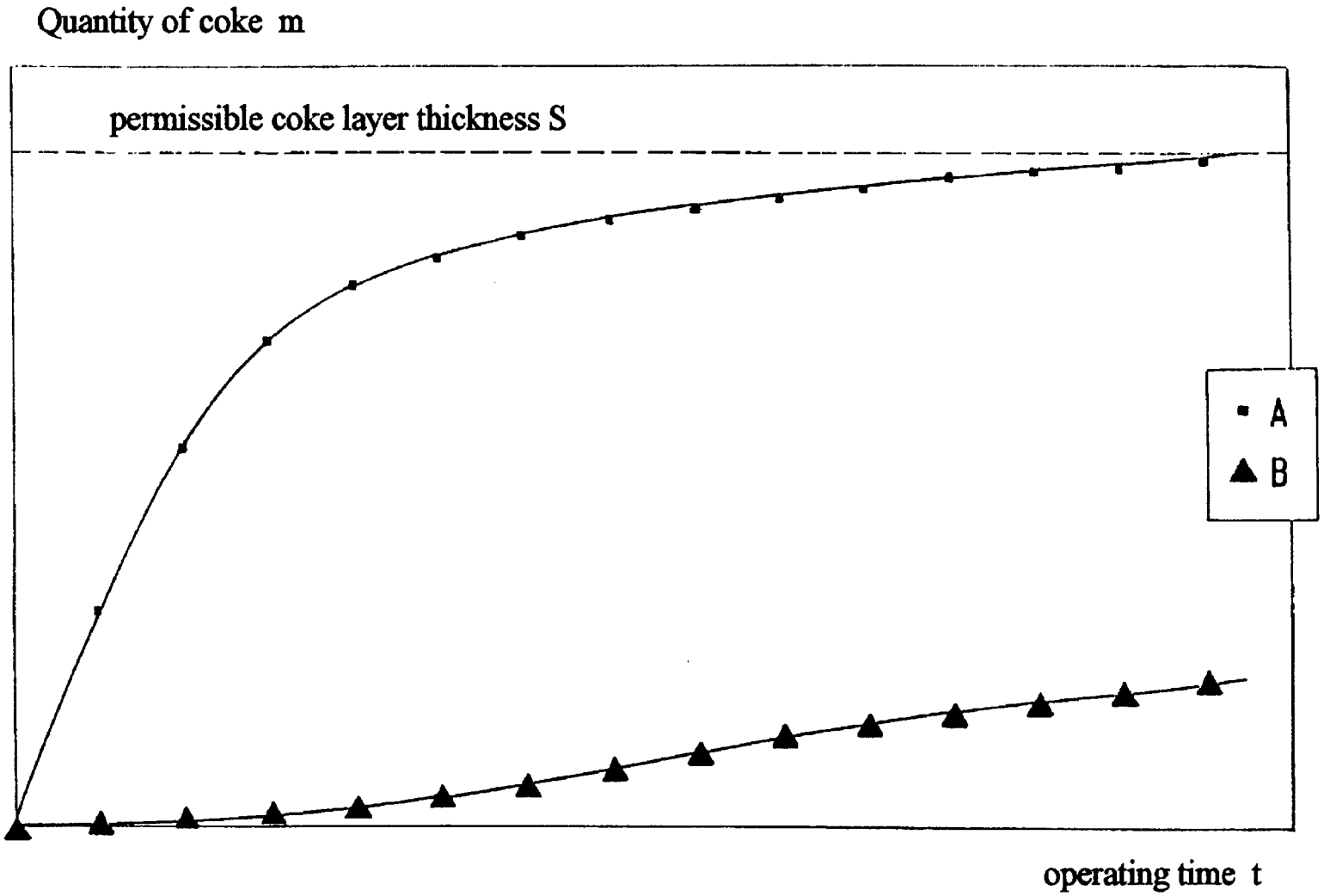
FIG. 1 shows the dependency of the amount of deposited coke-like products on the reaction time t in an apparatus according to the prior art.
Figure 2:
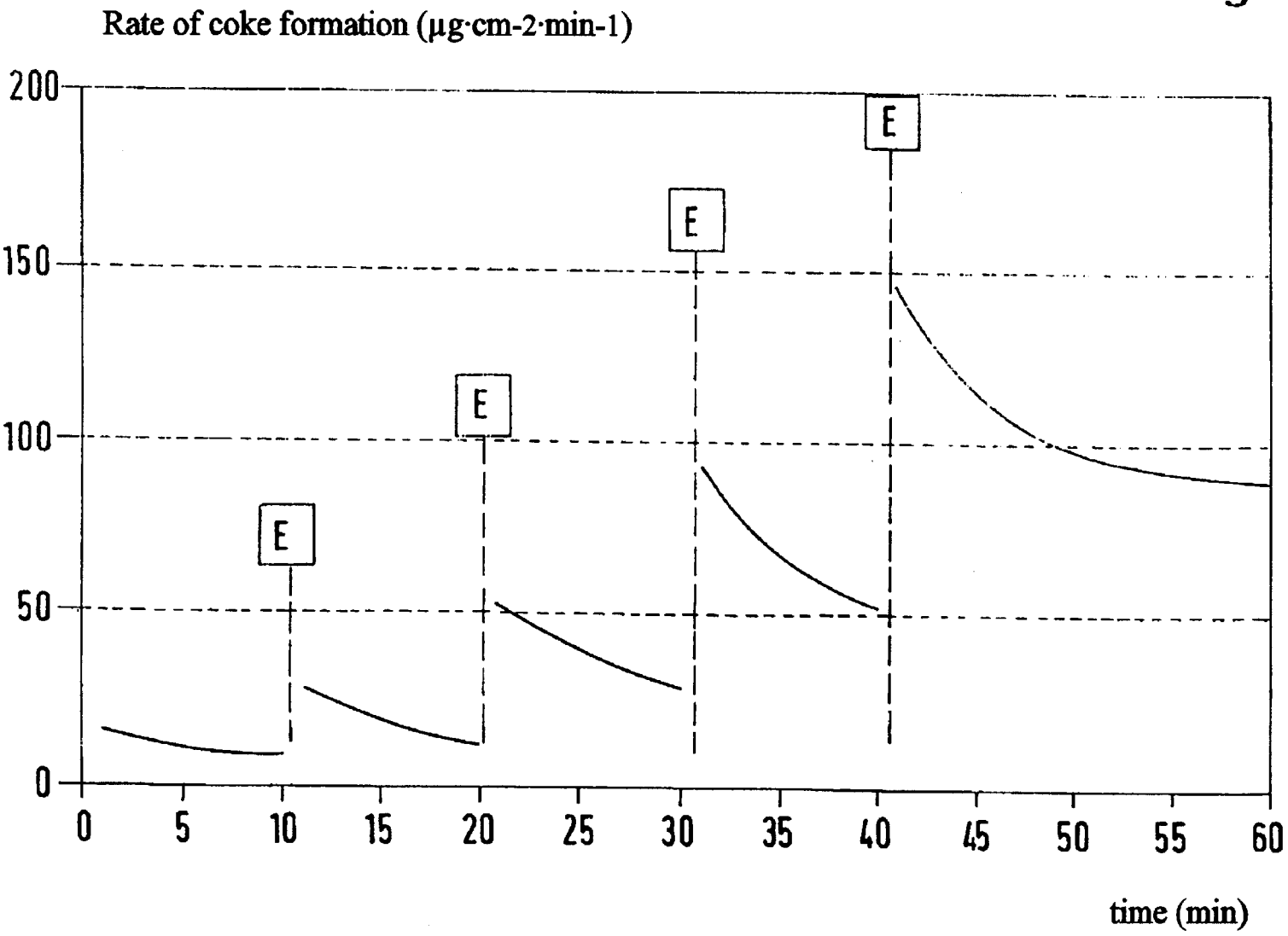
FIG. 2 shows an example of the dependency of the coke-forming rate in a test piece of chromium-nickel steel X 8 CrNiTi 18 10 which has been preactivated (E=decoking with air) but not pretreated, according to the invention, on the test period during pyrolysis of pure n-heptane ($T_R$=715° C., $\tau$=1 s, $N_2$ as diluent)

In a pyrolysis apparatus of this kind made from silica glass ($d_i$=20 mm; $V_R$=13 ml) to which is connected a separately heated tube segment of silica glass of identical diameter in which gas chamber temperatures corresponding to those used in industrial tubular heat exchangers for cooling pyrolysis gases can be simulated, n-heptane as model hydrocarbon was pyrolyzed at temperatures between 715 and 800° C. under conditions leading to an ethylene-to-propylene mass ratio in the pyrolysis gas between 2.0 and 2.7. When pyrolysis is carried out in nitrogen as diluent ($n_{heptane}$:$n_{N^2}$=0.5) and in the presence of material test pieces on which coke has been deposited repeatedly in order to bring about increased catalytic coke formation by pyrolysis and in which the coke was subsequently burned off, absolute coking rates r can be measured subsequently, these coking rates preferably ranging between r=50 and 300 $\mu$g/cm$^2$·min. The level of the measured coking rates is an integral measurement value which, at a defined cracking intensity and under defined cracking conditions, is characteristic of the respective measured test piece, but also depends to a great extent on the number of coking/decoking cycles undergone by the respective test piece. A typical example for the dependency of the coking rate in a test piece of chromium-nickel steel X 8 CrNiTi 18 10 on the reaction time during pyrolysis of n-heptane at 780° C. is shown in FIG. 2 for five successive coking/decoking cycles.

EXAMPLE 2

Comparison Example

In the same apparatus and under external conditions analogous to those described in Example 1, the curve of the coking rate was first determined on a preactivated test piece of X 8 CrNiTi 18 10 during the pyrolysis of n-heptane at 715° C. over a test period of 60 minutes. The n-heptane, as pyrolysis charging product, was then substituted by a n-heptane charge containing 85 ppm dimethyl disulfide, a compound which is known and used industrially as a coking inhibitor.

Figure 3:
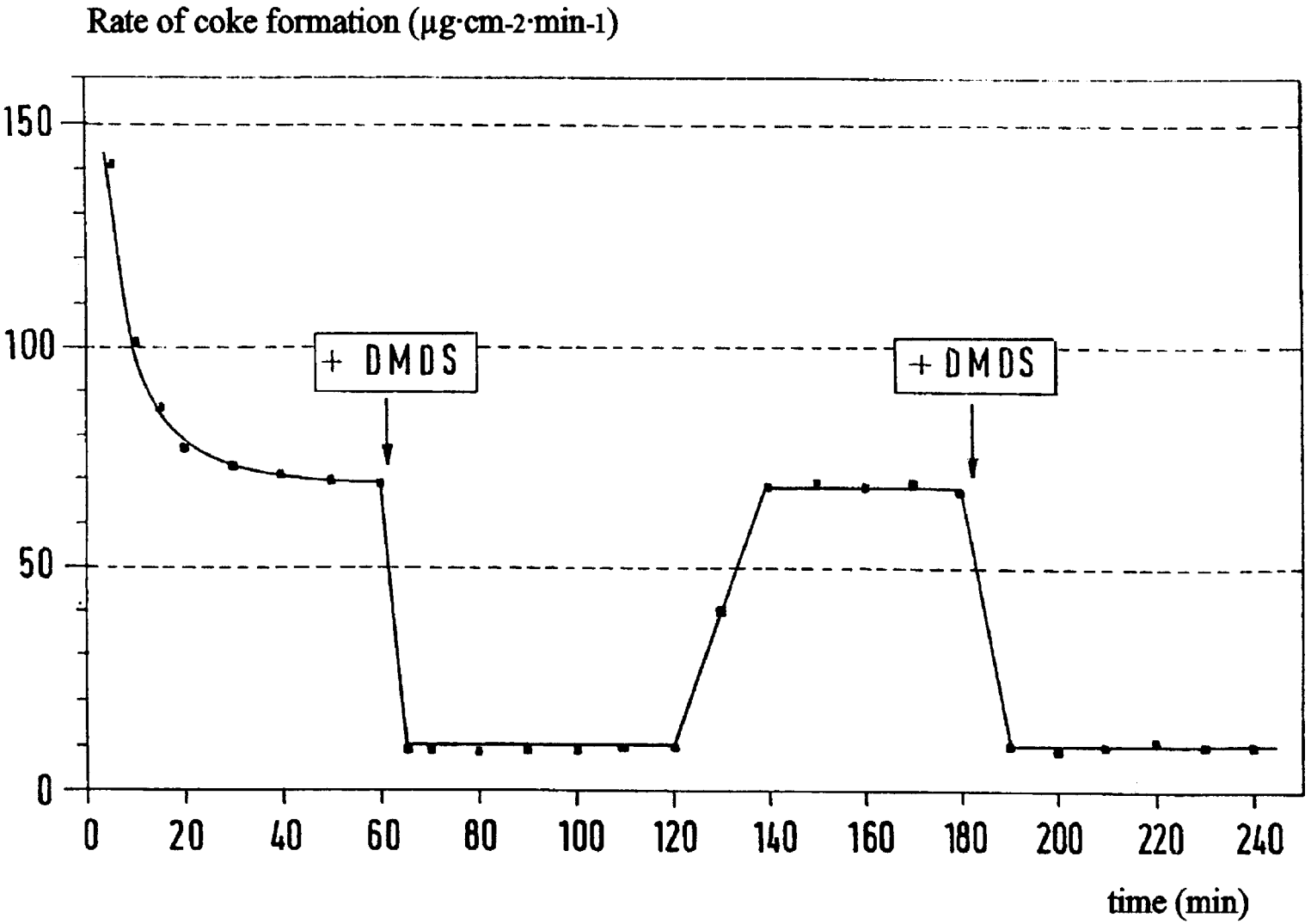
FIG. 3 shows the influence of 85 ppm dimethyl disulfide (DMDS), as an addition to n-heptane, on the rate of coke formation in a test piece of X 8 CrNiTi 18 10 which has been preactivated but not pretreated, according to the invention, in relation to the test period during pyrolysis of n-heptane ($T_R$=715° C., $\tau$=1 s, $N_2$ as diluent)

FIG. 3 illustrates the curve of the coking rates measured on the employed test piece as a function of the test period. The aforementioned charging product was changed repeatedly. The measured differences in the coking rates confirm the inhibiting effect of dimethyl disulfide on coke formation on metallic material surfaces.

EXAMPLE 3

Comparison Example

Figure 4:
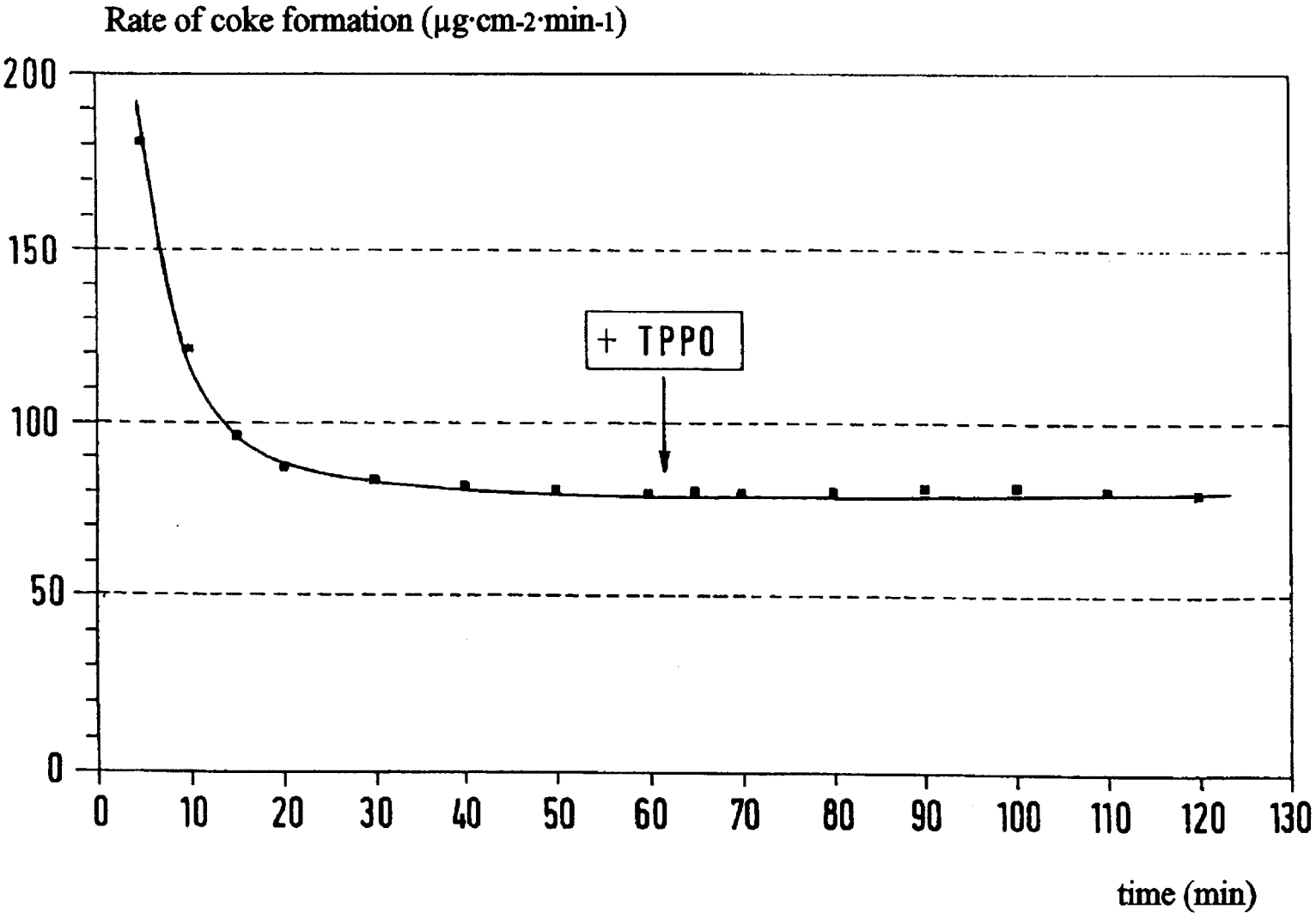
FIG. 4 shows the influence of 1000 ppm triphenylphosphine oxide (TPPO) instead of dimethyl disulfide as an addition to n-heptane on the rate of coke formation in a test piece of X 8 CrNiTi 18 10 which has been preactivated but not pretreated, according to the invention, in relation to the test period during pyrolysis of n-heptane ($T_R$=715° C., $\tau$=1 s, $N_2$ as diluent)

In the same apparatus as that described in Example 1 and under the conditions described in the example, the effect of a known phosphorus-containing inhibitor, as disclosed in U.S. Pat. No. 4,900,426, on the coking rate at 715° C. was plotted instead of the dimethyl disulfide. The results of the investigations are compiled in FIG. 4. It will be seen that an addition of 1000 ppm triphenylphosphine oxide (the P content is standardized to the S content of the compound used in Example 2) to the n-heptane does not have a discernable effect on its coke-forming tendency under the applied pyrolysis conditions.

EXAMPLE 4

Embodiment Example According to the Invention

Figure 5:
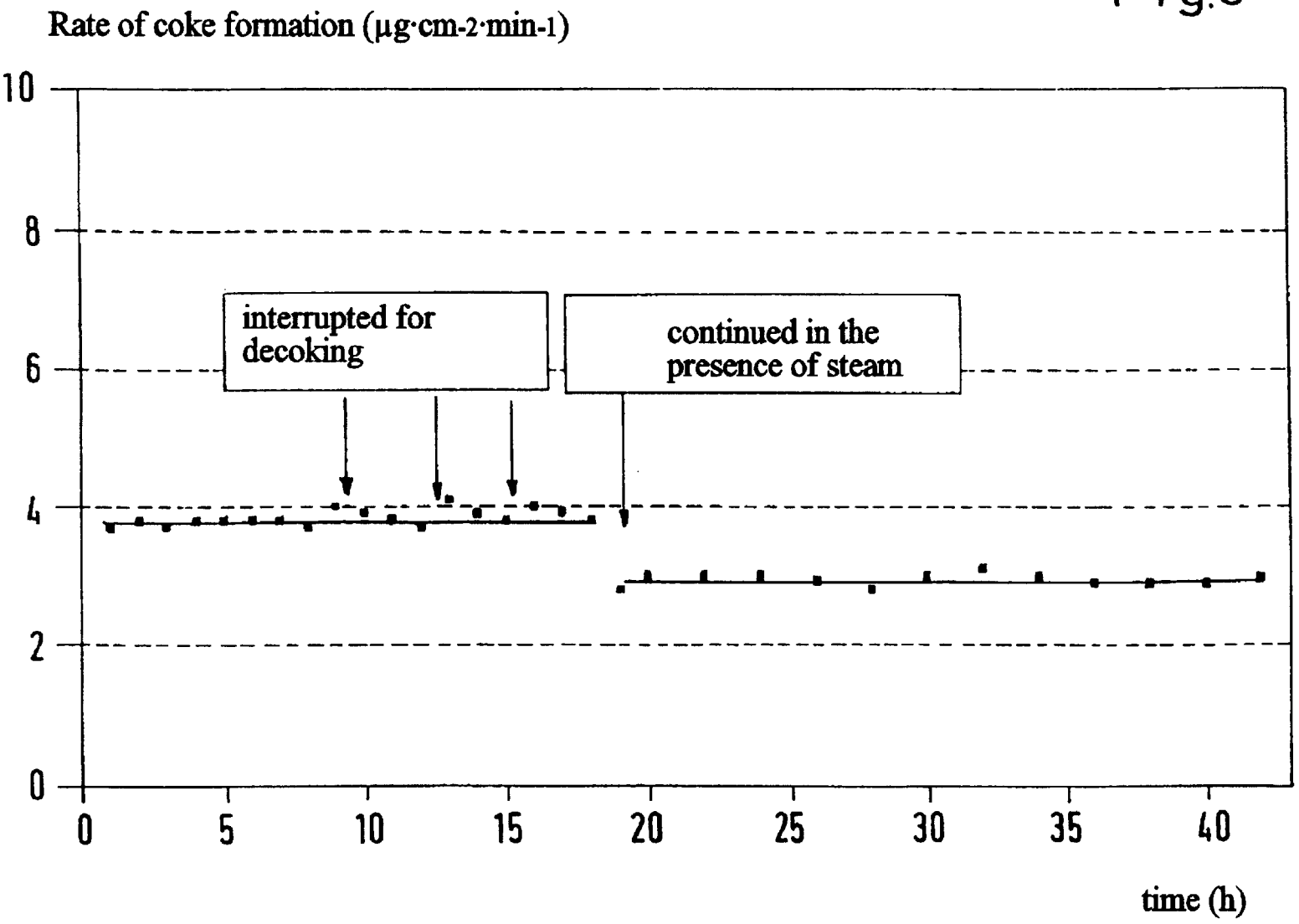
FIG. 5 shows the dependency of the rate of coke formation on a preactivated test piece of X 8 CrNiTi 18 10 which has already been decoked multiple times and thermally pretreated at 880° C. according to the invention with trimethylsilylmethyl mercaptan in relation to the test period during pyrolysis of n-heptane and with repeated interruption of the pyrolysis reaction for the purpose of burning off deposited coke by means of air ($T_R$=715° C., $\tau$=1 s, $N_2$ and steam, respectively, as diluent)

In the same apparatus as that described in Example 1, a repeatedly preactivated test piece of X 8 CrNiTi 18 10 was treated for a period of 60 minutes with a 3 l/h flow of gas (volume rate V=25 ml/ml·min) of 0.005 moles trimethylsilylmethyl mercaptan in 3 liters of a dry equimolar mixture of hydrogen and methane at 880° C. The reactor was flushed for 5 minutes with nitrogen at 715° C. Subsequently, n-heptane was pyrolyzed in the presence of nitrogen ($n_{heptane}:n_{N^2}=0.5$) at 715° C., as was described in Example 1, and the coking rate on the pretreated test piece was determined as a function of the reaction time (FIG. 5). The coking rate of r=4 $\mu g/cm^2 \cdot min$ remained virtually constant over a test period of more than 18 hours. By arbitrary interruption of the test, the surface of the test piece was cleaned after 8, 12, and 15 hours by means of burning off the coke with air. There was no impairment of the surface passivity. After 18 test hours, the nitrogen used as diluent was replaced by steam and the test was continued for an additional 24 hours. The coking rate dropped to values of around 3 $\mu m/cm^2 \cdot min$ and remained virtually constant over the aforementioned test period.

EXAMPLE 5

Embodiment Example According to the Invention

Figure 6:
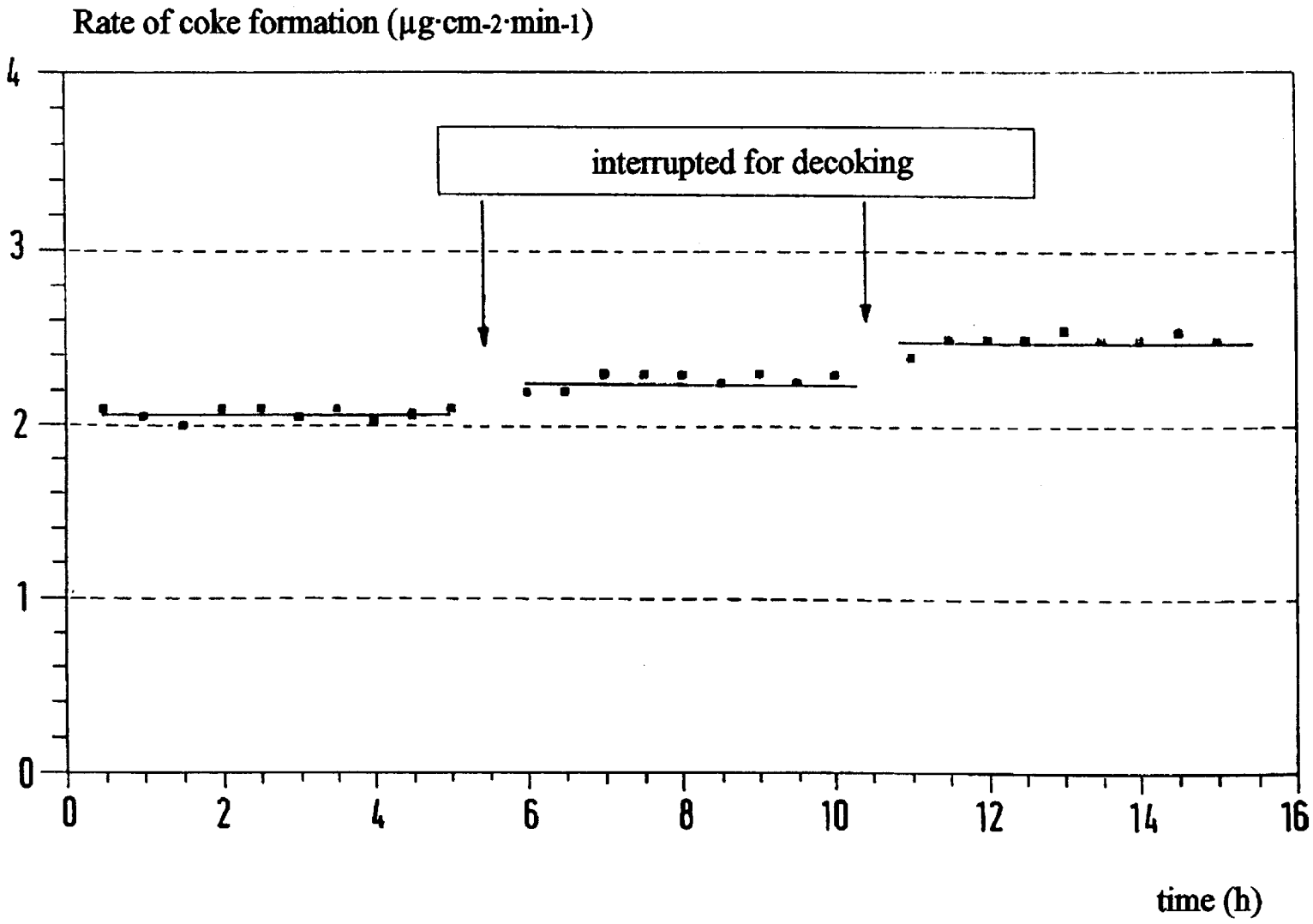
FIG. 6 shows the dependency of the coking rate on the test period in a test piece of unused preactivated Incoloy 800 which has been pretreated according to the invention in relation to the test period during pyrolysis of n-heptane and with repeated interruption of the pyrolysis reaction for the purpose of burning off deposited coke by means of air ($T_R$=715° C., $\tau$=0.6 s, steam as diluent)

In the same apparatus as that described in Example 1, a test piece of unused Incoloy 800, as mentioned in Example 4, was pretreated under the conditions indicated in Example 4 and the coking rate during pyrolysis of n-heptane at 750° C. was subsequently plotted. The pyrolysis was carried out in the presence of steam instead of nitrogen as diluent. In FIG. 6, the measured coking rates were plotted relative to the test periods. The pyrolysis was interrupted repeatedly and the test piece was decoked with air. The results show that the coking rate has low values of around 2.5 $\mu m/cm^2 \cdot min$ over the entire testing period.

EXAMPLE 6

Embodiment Example According to the Invention

In the same apparatus as that described in Example 1 and under the conditions described in Example 4, the influence of the carrier gas used for pretreatment on the coking rate during pyrolysis of n-heptane was investigated. Hydrogen, methane, nitrogen and steam were used instead of a 1:1 mixture of hydrogen and methane. The variation in the carrier gas used for pretreatment shows that steam is not suitable for long-lasting suppression of coking on materials pretreated with trimethylsilylmethyl mercaptan. After comparable low initial values (r=1.7 $\mu m/cm^2 \cdot min$) were measured, the coking rate increased continuously and reached a value of r=25 $\mu m/cm^2 \cdot min$ again after a test period of only 120 minutes.

Figure 7:
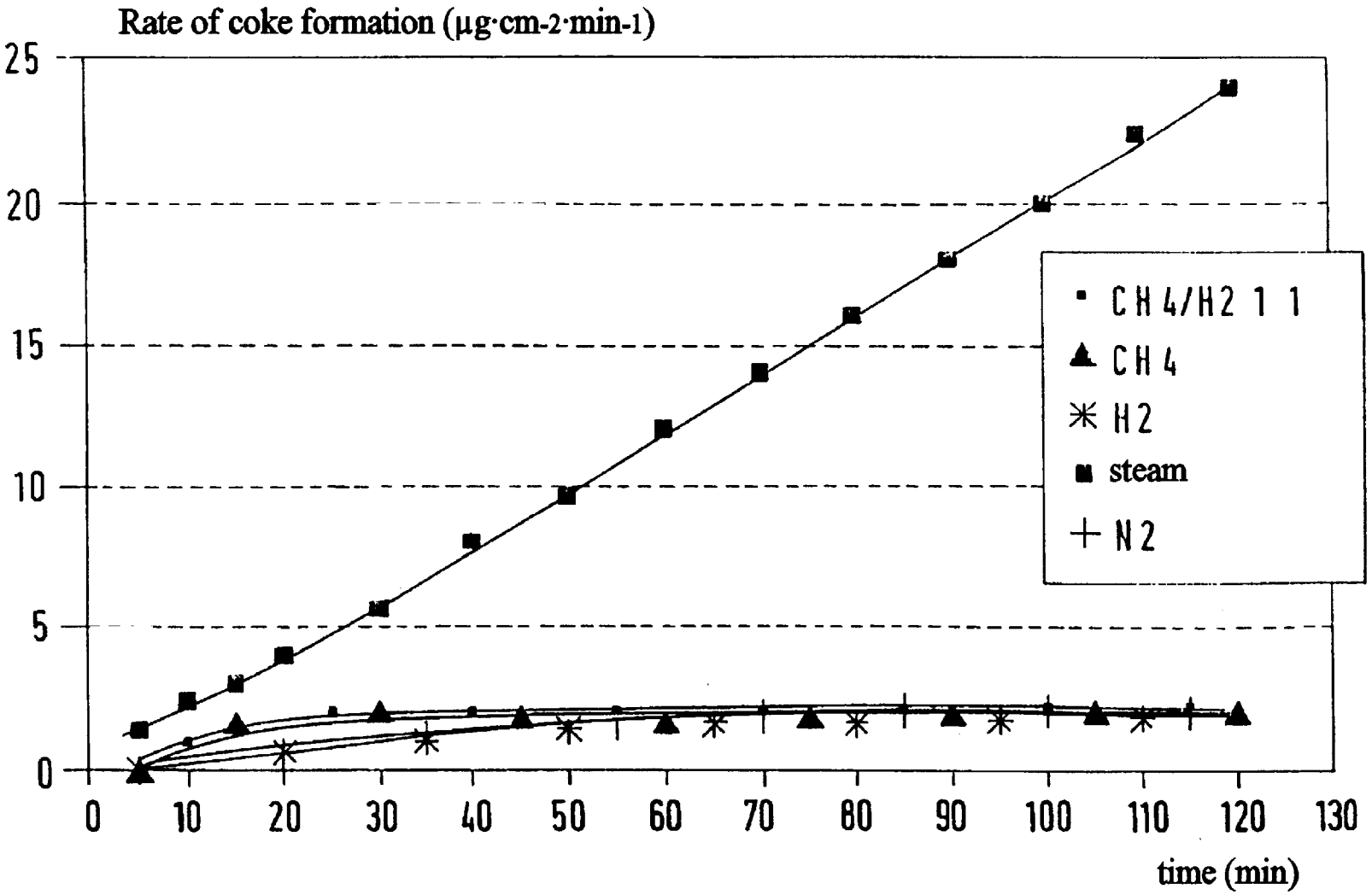
FIG. 7 shows the influence of the carrier gas used for the thermal pretreatment of the test piece of X 8 CrNiTi 18 10 on the coking rate during the pyrolysis of n-heptane ($T_R$=715° C., $\tau$=1 s, $N_2$ as diluent)

FIG. 7 shows the coking rates measured after the corresponding pretreatments during pyrolysis of n-heptane at the surface of the test piece as a function of the test period.

EXAMPLE 7

Embodiment Example According to the Invention

In the apparatus described in Example 1, preactivated test pieces of X 8 CrNiTi 18 10 were treated at four different temperatures over a time period of 60 minutes in each instance with a 3 l/h equimolar gas flow of hydrogen and methane to which 0.005 moles of trimethylsilylmethyl mercaptan was added. After this treatment and after flushing the reactor with nitrogen, the coking rates were measured at the test pieces during pyrolysis of n-heptane in the presence of nitrogen at 715° C. ($n_{heptne}:n_{N^2}=0.5$).

Figure 8:
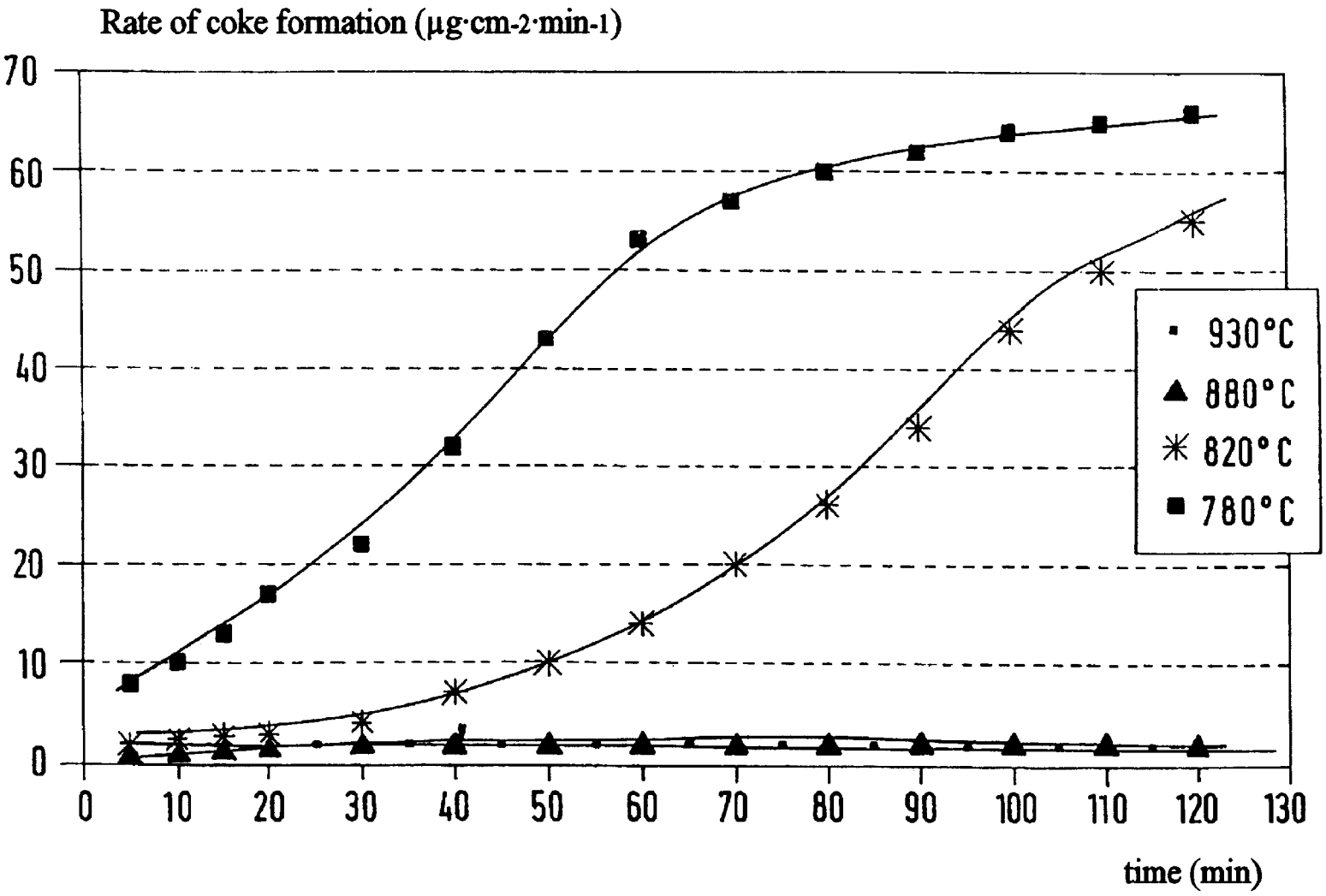
FIG. 8 illustrates the temperature influence in the pretreatment, according to the invention, of the test piece of X8 CrNiTi 18 10 on the dependency of the coking rate on the test period during the pyrolysis of n-heptane ($T_R$=715° C., $\tau$=1 s, $N_2$ as diluent)

In FIG. 8 the coking rates measured at the test pieces treated with trimethylsilylmethyl mercaptan at four different temperatures are shown as a function of the reaction time. It will be seen that the treatment of the material surfaces according to the invention before the pyrolysis of hydrocarbons is dependent on the pretreatment temperature. At pretreatment temperatures of more than 880° C., the coking is suppressed for lengthy periods.

EXAMPLE 8

Embodiment Example According to the Invention

Figure 9:
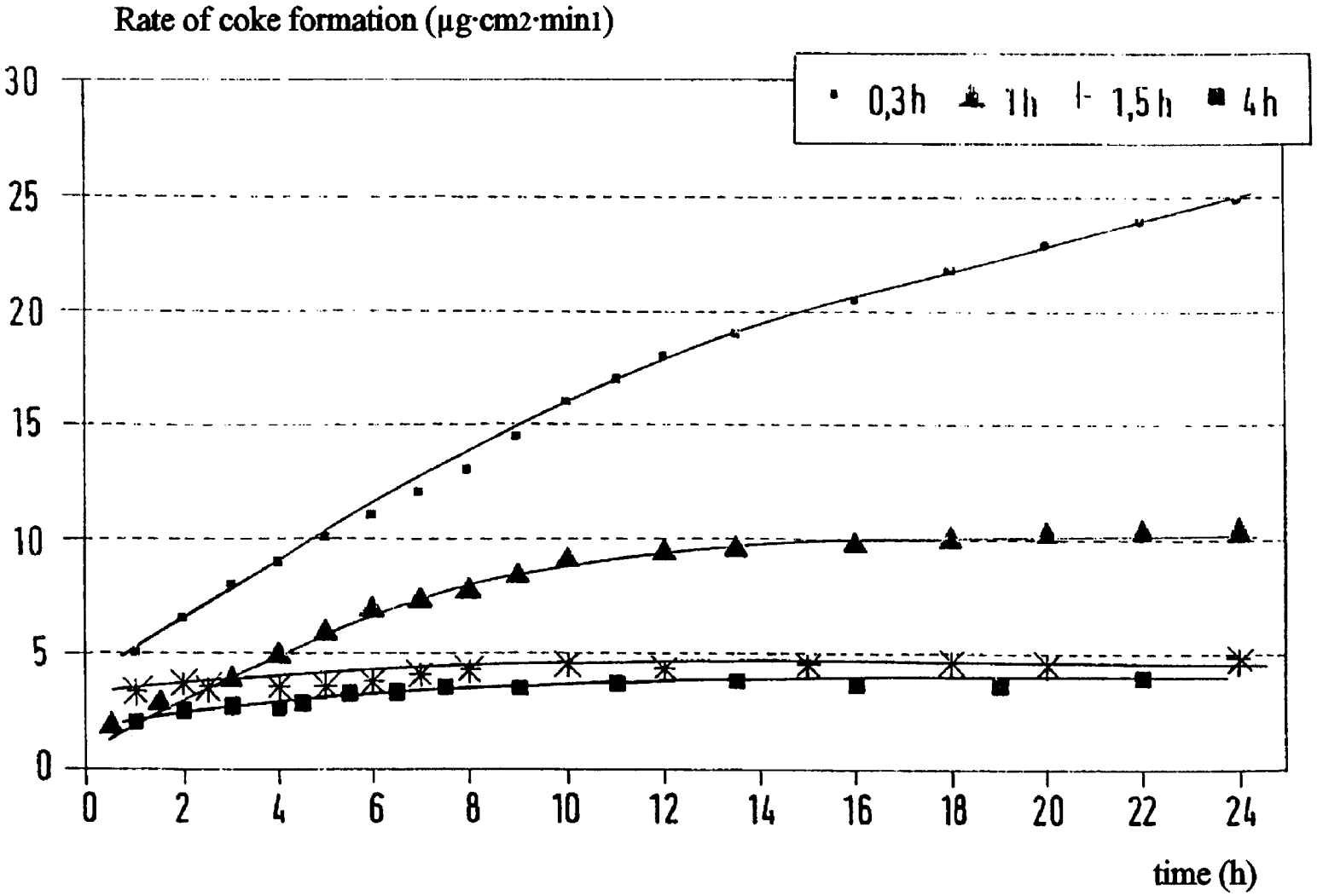
FIG. 9 illustrates the influence of the pretreatment time on the dependency of the coking rate on the test period during the pyrolysis of n-heptane ($T_R$=715° C., $\tau$=1 s, $N_2$ as diluent)

Preactivated test pieces of X 8 CrNiTi 18 10 were pretreated at 900° C. over different lengths of time with an equimolar mixture of hydrogen and methane containing trimethylsilylmethyl mercaptan in the same apparatus as that described in Example 1 and under conditions analogous to those described in Example 7. The coking rates which were subsequently measured at these test pieces during the pyrolysis of n-heptane in nitrogen at 715° C. as a function of the test period are shown for four test pieces in FIG. 9.

The variation of the pretreatment period shows that the coke formation can be suppressed in an equally effective manner in pretreatment periods greater than 1 h over lengthy test periods.

EXAMPLE 9

Embodiment Example According to the Invention

In the same apparatus as that described in Example 1 and under the same conditions as those indicated in Example 4, the influence of the type and composition of the silicon- and sulfur-containing compounds on the coking rate during pretreatment of a preactivated test piece by means of a carrier gas comprising 50 mol-% hydrogen and 50 mol-% methane was investigated during pyrolysis of n-heptane in nitrogen as diluent.

The test pieces which were obtained at a pretreatment temperature of 880° C., a pretreatment period of 60 minutes, and with a proportion of 0.005 moles of the silicon- and sulfur-containing compound or of the sum of silicon- and sulfur-containing compounds in a 3 l/h equimolar hydrogen-methane mixture were subjected one after the other to the reactive gas phases occurring during pyrolysis and the coking rates at this test pieces were measured as a function of the reaction time.

Table 1 shows the coking rates which were obtained at the test pieces pretreated with different silicon- and sulfur-containing compounds as a function of the test period.

It will be seen that the object of the pretreatment according to the invention is not limited to the use of compounds simultaneously containing silicon and sulfur. Rather, this object is also met when compounds containing silicon or sulfur are applied in a mixture. In so doing, the pretreatment according to the invention is ensured over a wide range of atomic ratios of silicon to sulfur. A particularly advantageous ratio is Si:S=2:1 to 1:1.

EXAMPLE 10

Embodiment Example According to the Invention

In the same apparatus as that described in Example 1 and under conditions analogous to those indicated in Example 4, the influence of the content of trimethylsilylmethyl mercaptan in the equimolar hydrogen-methane mixture used for pretreatment on the coking rate in test pieces of X 8 CrNiTi 18 10 was determined. Differing amounts of trimethylsilylmethyl mercaptan (0.002, 0.005, 0.01, and 0.02 moles) were added to the hydrogen-methane mixture (3 l/h) used for the pretreatment and the pretreatment was carried out in each instance with 3 l of the conditioned carrier gas indicated above over a period of 60 minutes at 880° C.

The coking rates measured at the test pieces which were pretreated depending on the trimethylsilylmethyl mercaptan content in the hydrogen-methane mixture during the pyrolysis of n-heptane in the nitrogen flow at 715° C. are shown in Table 2.

The results showed no substantial dependency between the measured coking rates and the trimethylsilylmethyl mercaptan content in the hydrogen-methane mixture used for the pretreatment.

EXAMPLE 11

Comparisons and Invention

Figure 10:
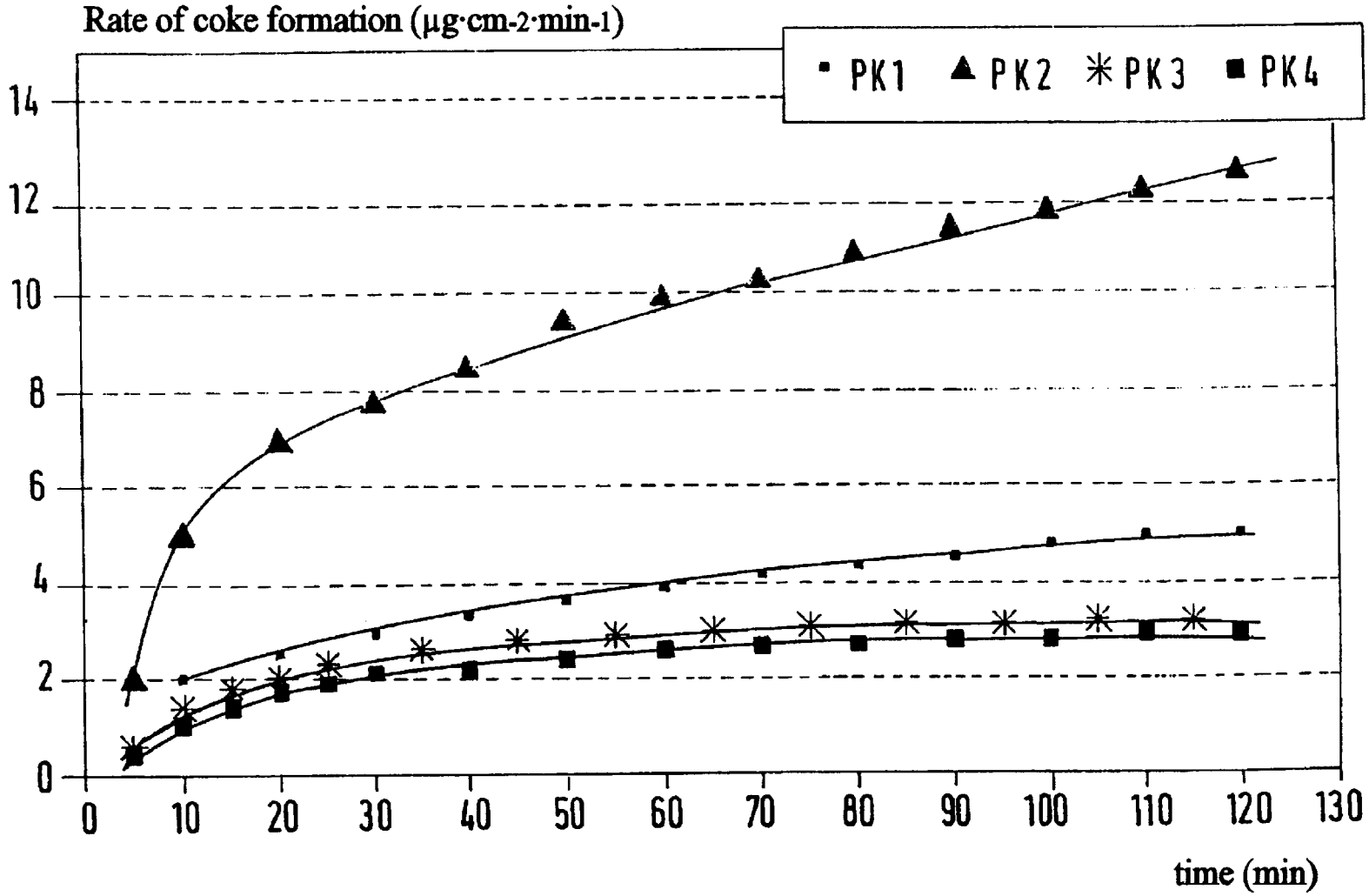
FIG. 10 shows the dependency of the coking rate on different pretreated test pieces of X 8 CrNiTi 18 10 on the test period during the pyrolysis of n-heptane ($T_R$=715° C., $\tau$=1 s, $N_2$ as diluent).

In a laboratory pyrolysis apparatus according to Example 1, four test pieces of X 8 CrNiTi 18 10 were treated in each instance over a time period of 60 minutes at 880° C. with a 3 l flow of gas containing hydrogen and methane in equimolar amounts, to which were added 0.005 mole tetramethylsilane (test piece PK 1) or dimethyl sulfide (test piece PK 2) or a 1:1 mixture of tetramethylsilane and dimethyl sulfide (test piece PK 3) or trimethylsilylmethyl mercaptan (test piece PK 4). Accordingly, only test pieces PK 3 and PK 4 were treated according to the invention. All four test pieces were subsequently subjected, one after the other, to the reactive gas phase occurring in the pyrolysis of n-heptane in the nitrogen flow at 715° C. (dwell period 1 s) and the coking rates on these test pieces were measured as a function of the duration of the pyrolysis tests. The results are shown in the form of a graph in FIG. 10. A comparison shows that the low coking rates typical for all test pieces were maintained over long test periods only in test pieces 3 and 4 which were pretreated according to the invention. It must be concluded from the determined data that the pretreatment according to the invention enables a significantly prolonged operating time compared to an operation without pretreatment or with a compound containing only silicon or sulfur.

TABLE 1

Influence of the ratio of silicon to sulfur in the inert gas (total content of Si—S additive: 0.005 moles) used for the pretreatment of preactivated test pieces of X 8 CrNiTi 18 10 (880° C., 60 min) on the coking rate r during the pyrolysis of n-heptane in the nitrogen flow

| | a) | b) | c) | d) | e) | f) | g) |
|---|---|---|---|---|---|---|---|
| atornicratio Si:S | 1:1 | 1:1 | 2:1 | 2:1 | 3:1 | 4:1 | 5:1 |
| test period [min] | | | r[$\mu \cdot cm^{-2} \cdot min^{-1}$] | | | | |
| 10 | 3.0 | 2.9 | 2.8 | 3.0 | 3.5 | 3.8 | 4.8 |
| 30 | 3.1 | 3.2 | 3.0 | 3.0 | 4.0 | 4.2 | 5.0 |
| 50 | 3.0 | 3.0 | 2.9 | 2.8 | 4.0 | 4.4 | 5.5 |
| 70 | 3.1 | 3.0 | 3.0 | 3.1 | 4.1 | 4.5 | 5.2 |
| 90 | 3.2 | 3.3 | 3.1 | 3.2 | 4.2 | 4.7 | 5.8 |
| 100 | 3.2 | 3.2 | 3.0 | 3.3 | 4.3 | 4.6 | 5.6 |

Si, S compounds used for pretreatment:
a) trimethylsiiylmethyl mercaptan
b) 1: 1 mixture of tetramethylsilane and dimethyl sulfide
c) bis(trimethylsilyl) sulfide
d) 2: 1 mixture of tetramethylsilane and dimethyl sulfide
e) 3: 1 mixture of tetramethylsilane and dimethyl sulfide
f) 4: 1 mixture of tetramethylsilane and dimethyl sulfide
g) 5: 1 mixture of tetramethylsilane and dimethyl sulfide

TABLE 2

Dependency of the coking rate r on the trimethylsilylmethyl mercaptan content in the inert gas of the thermal pretreatment of test pieces of X 8 CrNiTi 18 10 during the pyrolysis of n-heptane in the nitrogen flow

| Content of trimethylsilylmethyl mercaptan in the inert gas [mol] / test period [min] | 0.002 | 0.005 | 0.01 | 0.02 |
|---|---|---|---|---|
| | r [$\mu g \cdot cm^{-2} \cdot min^{-1}$] | | | |
| 10 | 3.5 | 3.0 | 2.9 | 2.9 |
| 30 | 3.5 | 3.1 | 2.9 | 2.8 |
| 50 | 3.4 | 3.0 | 3.0 | 2.9 |
| 70 | 3.6 | 3.1 | 3.0 | 3.0 |
| 90 | 3.8 | 3.2 | 2.9 | 2.8 |
| 120 | 3.7 | 3.2 | 3.1 | 2.9 |

We claim:

1. A process for reducing coking of a heat exchanger metallic surface formed after a period of producing thermally cracked products from hydrocarbons in organic compounds, comprising:

contacting the metallic surface of the heat exchanger with a mixture of a silicon- and sulfur-containing product and a dry inert gas flow at a temperature of 300 to 1000° C. over a period of approximately 0.5 to 12 hours at least one of before and after cracking takes place.

2. The process of claim 1, said contacting step further comprises contacting the metallic surface at least one of before initial startup of operation and after cleaning of the metallic surface.

3. The process of claim 1, wherein the silicon- and sulfur-containing product is one of: a) at least one silicon- and sulfur-containing volatile compound; b), a mixture of silicon-containing volatile compounds and sulfur-containing volatile compounds, and c) a mixture of silicon- and sulfur-containing volatile compounds and at least one of volatile silicon-containing and volatile sulfur-containing compounds, wherein an atomic ratio of silicon to sulfur in the silicon- and sulfur-containing product is between 5:1 and 1:1.

4. The process of claim 3, wherein a molar ratio of the silicon- and sulfur-containing compound or the mixture of silicon- and sulfur-containing compounds to the inert gas is between 0.001 and 0.01.

5. The process of claim 4, wherein the molar ratio is between 0.001 and 0.004.

6. The process of claim 1, wherein the period is between approximately 0.5 to 8 hours.

7. The process of claim 1, wherein the period is between approximately 1 to 6 hours.

8. The process of claim 1, wherein the metallic surface comprises an inner tube surface of a tubular reactor subjected to coking and is contacted with the product at the temperature of 700 to 1000° C.

9. The process of claim 1, wherein the metallic surface comprises a surface of a heat exchanger subjected to coking and is contacted at the temperature of 300 to 750° C.

10. The process of claim 1, wherein the inert gas exits a reactor and is fed to the heat exchanger at a temperature above 500° C.

11. The process of claim 1, wherein the inert gas is one of nitrogen, hydrogen, and methane- and hydrogen-containing gases.

12. The process of claim 1, wherein the inert gas is methane- and hydrogen-containing residual gases from a column gas separation.

13. The process in accordance with claim 1, wherein the silicon- and sulfur-containing product consists of an organosilicon and an organosulfur containing product.

14. The process in accordance with claim 13, wherein the silicon- and sulfur-containing product includes of carbon and hydrogen atoms.

15. The process in accordance with claim 13, wherein the silicon- and sulfur-containing product comprises a silicon atom bonded adjacent to a sulfur atom.

16. A heat exchanger surface including a metallic surface treated in accordance with claim 1.

17. The heat exchanger of claim 16, wherein the silicon- and sulfur-containing product is one of: a) at least one silicon- and sulfur-containing volatile compounds; b) a mixture of silicon-containing volatile compounds and sulfur-containing volatile compounds; and c) a mixture of silicon- and sulfur-containing volatile compounds and at least one of volatile silicon-containing and volatile sulfur-containing compounds, wherein an atomic ratio of silicon to sulfur in the silicon- and sulfur-containing product is between 5:1 and 1:1.

18. The heat exchanger of claim 16, wherein the metallic surface comprises an inner tube surface of a tube reactor and is contacted with the product at the temperature of 700 to 1000° C.

19. The heat exchanger of claim 16, wherein the metallic surface comprises an inner tube surface of a tube reactor and is contacted with the product at the temperature of 800 to 1000° C.

20. The heat exchange surface of claim 16, wherein the metallic surface comprises a surface of a heat exchanger and is contacted with the product at the temperature of 300 to 750° C.

* * * * *